US006382539B1

(12) United States Patent
Gülke

(10) Patent No.: US 6,382,539 B1
(45) Date of Patent: May 7, 2002

(54) BLADE

(75) Inventor: Norbert Gülke, Hildesheim (DE)

(73) Assignee: Tiromat Krämer + Grebe GmbH & Co. KG, Biedenkopf-Wallau (DE)

( * ) Notice: Subject to any disclaimer, the term of this patent is extended or adjusted under 35 U.S.C. 154(b) by 0 days.

(21) Appl. No.: 09/666,031

(22) Filed: Sep. 21, 2000

Related U.S. Application Data

(63) Continuation of application No. PCT/EP99/01260, filed on Feb. 26, 1999.

(30) Foreign Application Priority Data

Mar. 28, 1998 (DE) ..... 198 14 012

(51) Int. Cl.[7] ..... B02C 25/00
(52) U.S. Cl. ..... 241/292.1
(58) Field of Search ..... 241/292.1, 30, 241/36, 37.5, 199.12

(56) References Cited

U.S. PATENT DOCUMENTS 4,770,568 A 9/1988 Perez et al.
4,964,578 A 10/1990 Bender

FOREIGN PATENT DOCUMENTS

DE 43 17 309 9/1994

*Primary Examiner*—Mark Rosenbaum
(74) *Attorney, Agent, or Firm*—Akin, Gump, Strauss, Hauer & Feld, L.L.P.

(57) ABSTRACT

In order to prevent damage due to inappropriate or unsuitable blades mounted in grinding machines such as cutters or mincers, the blades are equipped with a sensor chip which serves as a data memory and whose data serve as actual values for an actual value/set value comparison. The result of this comparison determines whether the grinding machine can or cannot be turned on.

9 Claims, 3 Drawing Sheets

BLADE

CROSS-REFERENCE TO RELATED APPLICATION

This application is a continuation of International Application No. PCT/EP99/01260 filed Feb. 26, 1999 the disclosure of which is incorporated herein by reference.

BACKGROUND OF THE INVENTION

The invention relates to a blade, in particular a blade fastenable to a blade head, said blade being a blade for a grinding machine for the grinding of meat and/or other substances of a similar nature, for instance for a cutter, and to a grinding machine with at least one such blade.

Such blades are used above all for meat processing in a so-called cutter, whereby a blade head can be pivoted into a rotating cutter bowl charged with meat to be ground and can also be offset in rotation and its replaceable blades perform the grinding of the meat. The blades are designed such that their cutting edges follow the contour of the domed inner wall of the cutter bowl at a (possibly small) distance at smaller or larger intervals. Such a blade head is usually equipped with several blades attached in an offset arrangement and/or on its rotary axis in several rows, one behind the other.

For proper function of the blades it is important that the distance of their cutting edges to the inner wall is optimal at all times and also remains unchanged at the magnitude envisaged by the cutter manufacturer when a blade is replaced; this is only regularly assured if a blade from the same manufacturer of suitable design in terms of its material and dimensions is employed; otherwise the functionally inappropriate distance from the inner wall may give rise to damage to the blade and the inner wall of the cutter as well as, and above all, operating disturbances. Nevertheless, different blades can be usually fitted to the same blade head in order to permit the manufacture of individual components efficiently and in large numbers.

SUMMARY OF THE INVENTION

Therefore, it is the object of the invention to design a blade of the type described in greater detail above such that it can be replaced solely by an equivalent blade of the same kind, thus reliably eliminating damage which could be caused by the use of a functionally inappropriate blade.

According to the invention, this object is achieved by installing in the blade a sensor chip which has an interrogatable first data memory containing data which are used as actual values for comparison with the data of a second data memory assigned to the grinding machine whose data attuned to the blade serve as the set value for an actual value/set value comparison, the control of the grinding machine being designed such that the latter cannot be turned on if the actual values deviate from the set values.

With a blade according to the invention, it is firstly truly ensured that its replacement by a blade not envisaged for the associated grinding machine does not succeed because in such a case the actual value/set value comparison fails and the grinding machine cannot be turned on at all. This applies both if an unsuitable blade from the same manufacturer and if a blade from a different manufacturer is fitted; in both cases the attention of the operator is drawn to the error and damage to the machine is reliably prevented.

Over and above the actual object, the invention has further advantages.

For instance, it is now possible to ensure on such grinding machines on which in addition to the blade the associated counterpart, for instance the perforated disc of a mincer, is replaceable that it is only possible to form such a pairing of blade/perforated disc if the respective components match, otherwise the grinding machine is again disabled by the control due to the actual value/set value comparison.

After appropriate data collection, transmission, processing and rendition, the data memory integrated in the blade also provides on a corresponding display the data suitable for the identification of the blade and optionally also those of the associated counterpart, that is of the entire system employed for grinding. In the same way the data can be recognized by the control of the grinding machine and referred to in so far as the operation of the grinding machine is only permitted if functionally appropriate components are employed.

The monitoring of the blades designed specifically for the grinding machine is also much simplified according to the invention because from the data suppliable by the integrated data memory the serial numbers of the blades are identifiable without difficulty and the wear of the blades can be monitored, for example through the indication of service life, grinding intervals and similar parameters. In this way the invention can also improve operation with those blades which are installed as original components or have been replaced with the correct replacement parts.

It is particularly advantageous if the sensor chip on the blade is provided in a closed cavity so that it is both indetectable to unauthorized persons and insusceptible to tampering. It has been shown to be beneficial to provide the sensor chip in a clamping section of the blade which is used for clamping the blade on the blade head. The arrangement can be effected without difficulty such that the sensor chip, if it is discovered by chance, becomes unserviceable upon removal of the data memory and the sensor chip is destroyed.

Data interrogation from the data memory integrated in such a blade succeeds best on a grinding machine according to the invention if the sensor chip is bidirectionally wirelessly linked to a transmitter-receiver which is either positioned on the grinding machine or remote, said transmitter-receiver being capable of connection via an amplifier to a second data memory and/or an electronic machine control so that the data level can be both rendered readable and referred to in deciding over the grinding machine's function. It is particularly advantageous to locate the transmitter-receiver in the immediate vicinity of the blade head.

For the subsequent equipping of a grinding machine in the manner specified in the invention, it is also beneficial if the amplifier, the second data memory and further electronic components and display and switching elements are provided in a joint modular unit on the machine stand of the grinding machine. The transmitter-receiver can also be beneficially designed as a remote unit.

BRIEF DESCRIPTION OF THE SEVERAL VIEWS OF THE DRAWINGS

The invention will be illustrated below in greater detail in the drawings with reference to an embodiment.

DETAILED DESCRIPTION OF THE INVENTION

Figure 1:
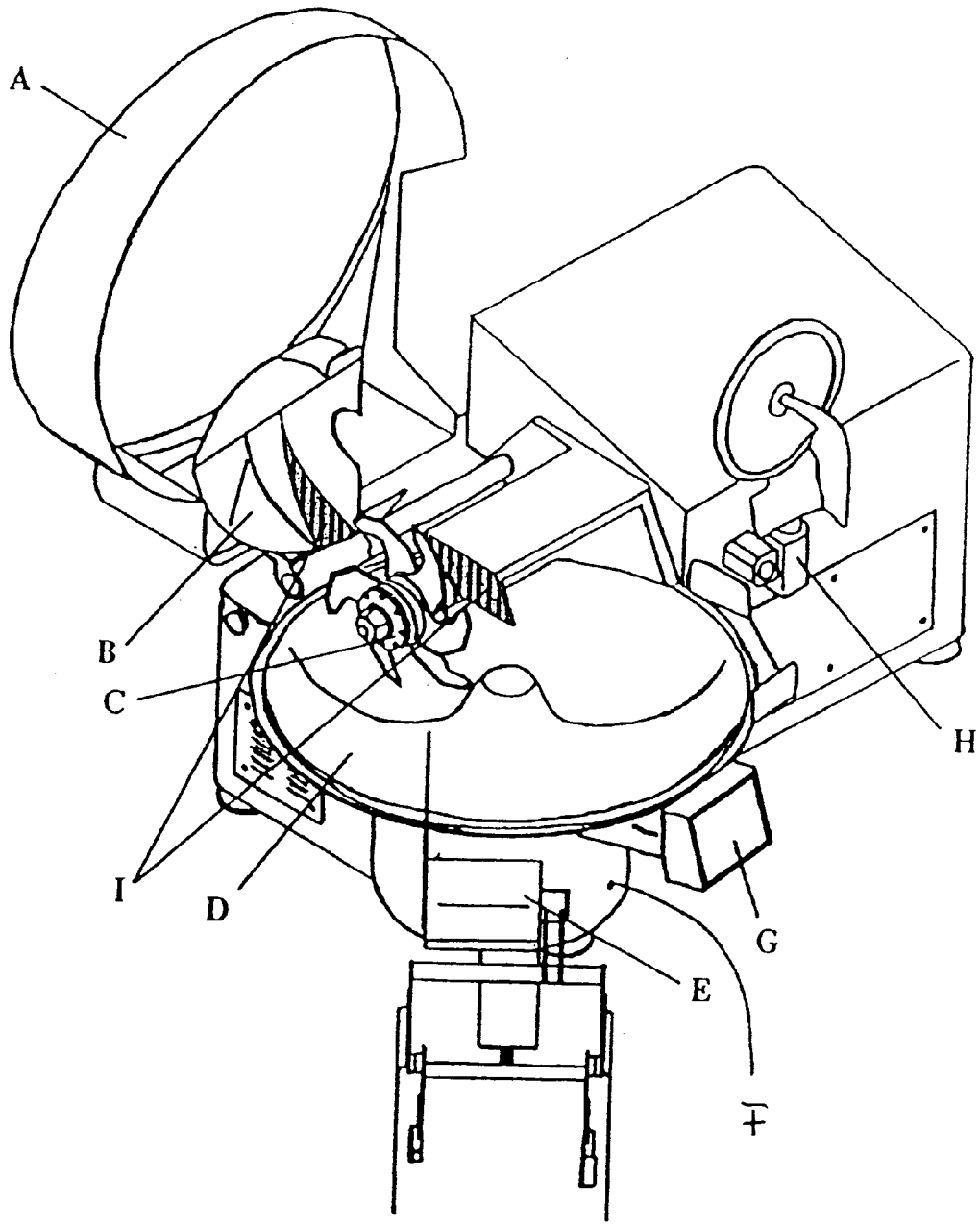
FIG. 1 shows a grinding machine.

A grinding machine according to the invention—in this case a so-called cutter, for example for the production of fine mince for sausages—consists according to FIG. 1 inter alia of a cutter bowl D which is mounted drivably about its (vertical) axis and into which a charging system E can feed meat for mincing which after processing can be removed again via an ejector H. Situated on a machine stand F of the cutter and covering the cutter bowl D is a pivotable cutter lid A which also encloses a blade head C for which a separate blade lid B is also provided. The blade head C and the blade lid B are attached to the machine stands F, as is a control panel G at which all of the measurement and control values necessary for the function of the cutter can be read and to some extent influenced. A transmitter-receiver 1 is provided on the machine stand F and attached to the latter by means of a fastener I, in FIG. 1 two possibilities being indicated, either on the blade lid B or on a holder for the blade head C.

Figure 2:
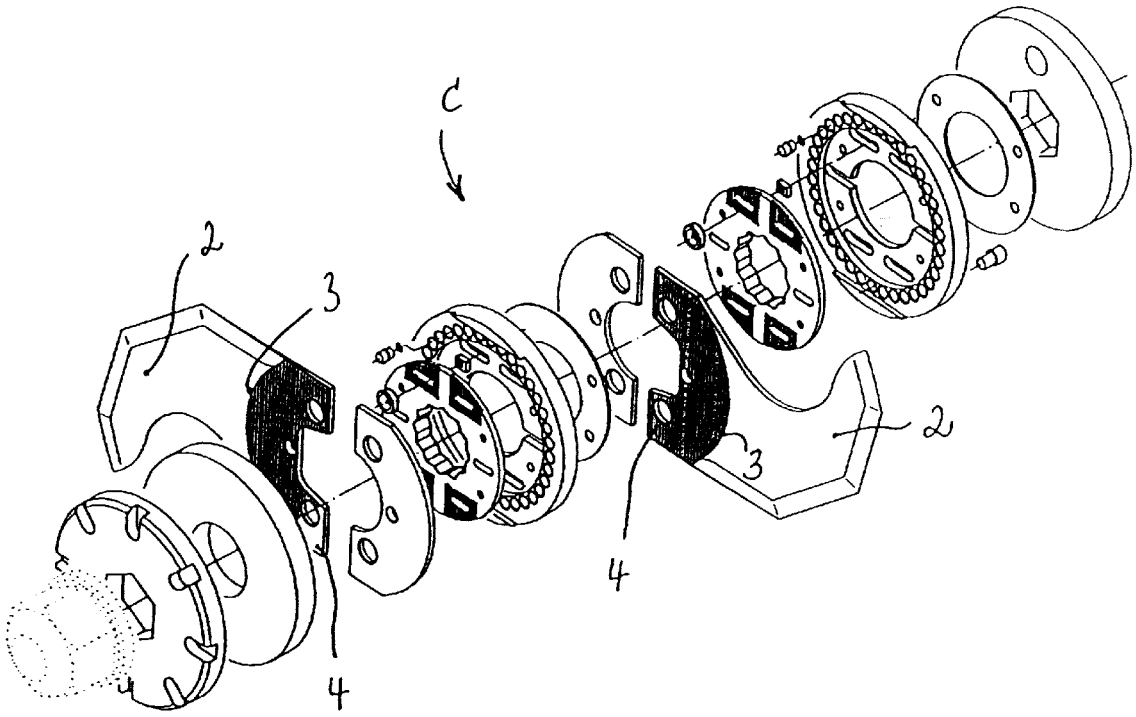
FIG. 2 shows an associated blade head according to the invention, both in three-dimensional representation.

FIG. 2 presents an exploded depiction of the blade head C with the blades 2 fully visible, that is also with their clamping sections 3 which are used for clamping them onto the blade head C and in each of which a recess 4 is identifiable. The recesses 4 each form a cavity for a sensor chip 5 (FIG. 3) which is mounted therein in an insertable or coverable fashion so that it is not usually detected by unauthorized persons; should it nevertheless be removed, it is then no longer possible to turn on the grinding machine (see below).

Figure 3:
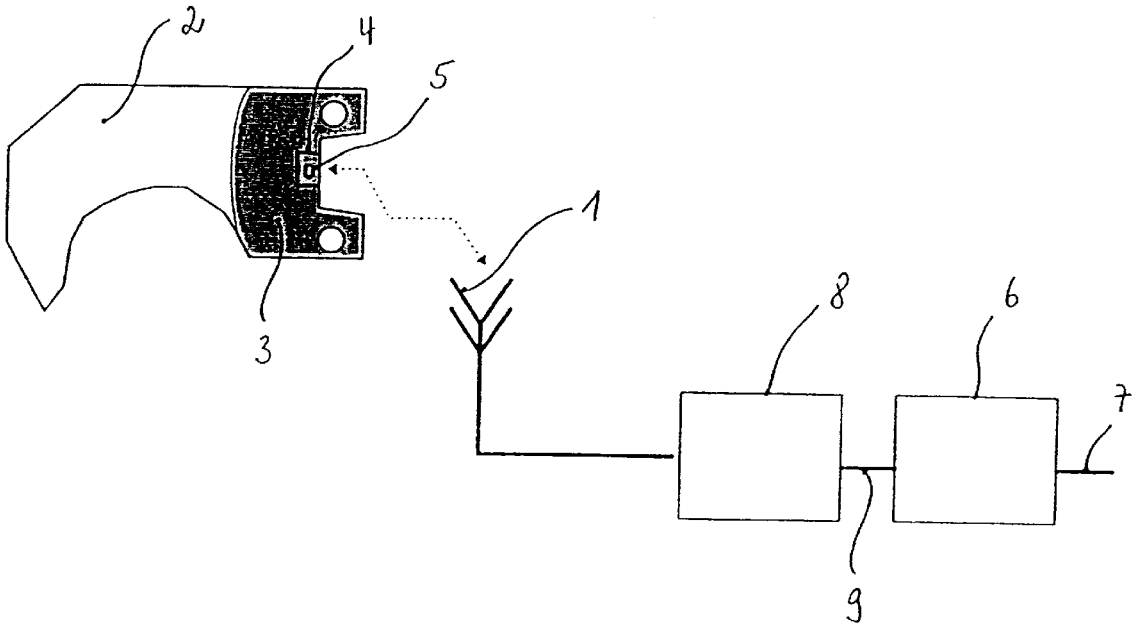
FIG. 3 shows a diagram of a means for data collection and processing according to the invention, all in simplified and partially symbolic representation.

The recess 4 can be attached to the blade 2 in a relatively arbitrary fashion; another possibility for this is shown by the arrangement in FIG. 3, where it is provided centrally in the clamping section 3 of the blade 2. Also indicated here is the sensor chip 5 which serves as a first data memory whose data are interrogatable and serve as actual values for an actual value/set value comparison. This comparison of data is served by a second data memory which is arranged as an integral element of a data processor 6 which is situated on the machine stand F and is linked at the same time to the control of the cutter as well; the data processor 6 is connectable via an interface 7 to a display or the like, which, for example, can be arranged on the control panel G. The transmitter-receiver 1, which is bidirectionally linked to the sensor chip 5 for data interchange, is connected in turn bidirectionally to the data processor 6 via an amplifier 8; in a similar way the control electronics for the cuter are connected at the interface 9 via an amplifier omitted in the drawing. Whilst (FIG. 1) the transmitter-receiver 1 is provided on a static part of the cutter in order simplify data interchange with the sensor chip 5, the amplifier 8 is situated on the machine stand F.

Reference List

A Cutter lid
B Blade lid
C Blade head
D Cutter bowl
E Charging system
F Machine stands
G Control panel, modular unit
H Ejector
I Fastener
1 Transmitter-receiver
2 Blade
3 Clamping surface
4 Recess, cavity
5 Sensor chip
6 Data processor
7 Interface
8 Amplifier
9 Interface

What is claimed is:

1. A blade fastenable to a blade head for a grinding machine for the grinding of meat and/or other substances comprising a sensor chip in the blade, the sensor chip having a writable and interrogatable first data memory with data which are used as actual values for comparison with data of a second data memory assigned to the grinding machine whose data attuned to the blade serve as the set value for an actual value/set value comparison, the control of the grinding machine being designed such that the latter cannot be turned on if the actual values deviate from the set values.

2. The blade according to claim 1, wherein the sensor chip is in a closed cavity on the blade.

3. The blade according to claim 2, wherein the sensor chip is provided in a clamping section of the blade, said clamping section being used for the clamping of the blade to the blade head.

4. A grinding machine for the grinding of meat and/or other substances, the grinding machine comprising:

a blade head; and a blade, fastened to the blade head, the blade including a sensor chip, the sensor chip having a writable and interrogatable first data memory with data which are used as actual values for comparison with data of a second data memory assigned to the grinding machine whose data attuned to the blade serve as the set value for an actual value/set value comparison, the control of the grinding machine being designed such that the latter cannot be turned on if the actual values deviate from the set values, the sensor chip being bi-directionally wirelessly linked to a transmitter-receiver.

5. The grinding machine according to claim 4 wherein the transmitter-receiver is connected via an amplifier to the second data memory and/or an electronic machine control.

6. The grinding machine according to claim 4, wherein the transmitter-receiver is provided in the immediate vicinity of the blade head.

7. The grinding machine according to claim 5, wherein the amplifier, the second data memory and further electronic components and display and switching elements are provided in a joint modular unit on a machine stand of the grinding machine.

8. The grinding machine according to claim 4, wherein the transmitter-receiver is provided with an amplifier and data memory.

9. The grinding machine according to claim 4, wherein the transmitter-receiver in located remotely from the grinding machine.

* * * * *